United States Patent [19]

Mangiarotti

[11] Patent Number: 4,917,118

[45] Date of Patent: Apr. 17, 1990

[54] METHOD OF MAKING CIGARETTES BY SIMULTANEOUSLY FORMING TWO SIDE-BY-SIDE ARRANGED RODS, AND CIGARETTE-MAKING MACHINE FOR CARRYING OUT THE SAID METHOD

[75] Inventor: Luigi Mangiarotti, Bologna, Italy

[73] Assignee: Sasib S.p.A., Italy

[21] Appl. No.: 120,125

[22] Filed: Nov. 13, 1987

[30] Foreign Application Priority Data

Dec. 23, 1986 [IT] Italy ..... 12606 A/86

[51] Int. Cl.[4] ..... A24C 5/00

[52] U.S. Cl. ..... 131/84.1; 131/84.2; 131/84.4

[58] Field of Search ..... 131/84.1, 84.2, 84.3, 131/84.4

[56] References Cited

U.S. PATENT DOCUMENTS 4,600,020 7/1986 Mattei et al. ..... 131/84.1

4,653,516 3/1987 Mattei ..... 131/84.1

*Primary Examiner*—V. Millin

*Assistant Examiner*—J. L. Doyle

*Attorney, Agent, or Firm*—Larson and Taylor

[57] ABSTRACT

The object of the invention is a method and a cigarette-making machine for simultaneously making two side-by-side arranged cigarette rods. According to the invention, in order to avoid, or at least reduce the inconveniences arising from the different dynamic behaviour of the two rod-forming folder belts (4) which are associated with the two rod-forming lines arranged side-by-side, and are passed around a common driving pulley (5), the twofold wide paper tape (6) fed to the two rod-forming lines, is longitudinally severed and split into two separate paper webs (61) only after its transversal double trough-like deformation (106,206,106), and after the deposition of a tobacco strand (7) in each one of its troughs (106), preferably even after a partial wrapping of the side edges of said tape (6) around the respective tobacco strands (7).

9 Claims, 6 Drawing Sheets

Fig 9
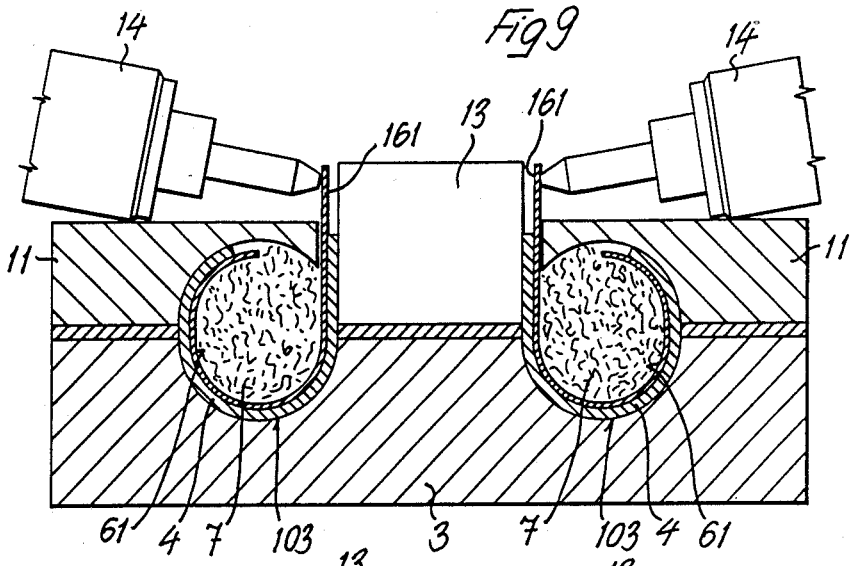
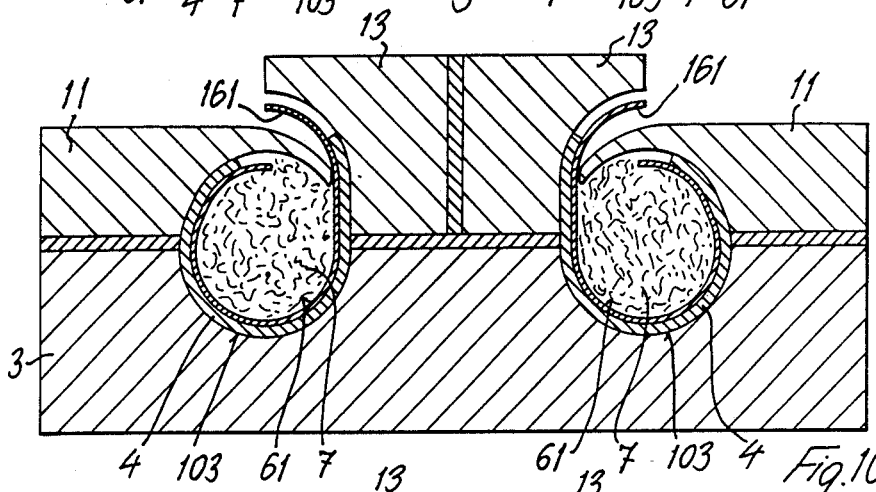
Fig.10
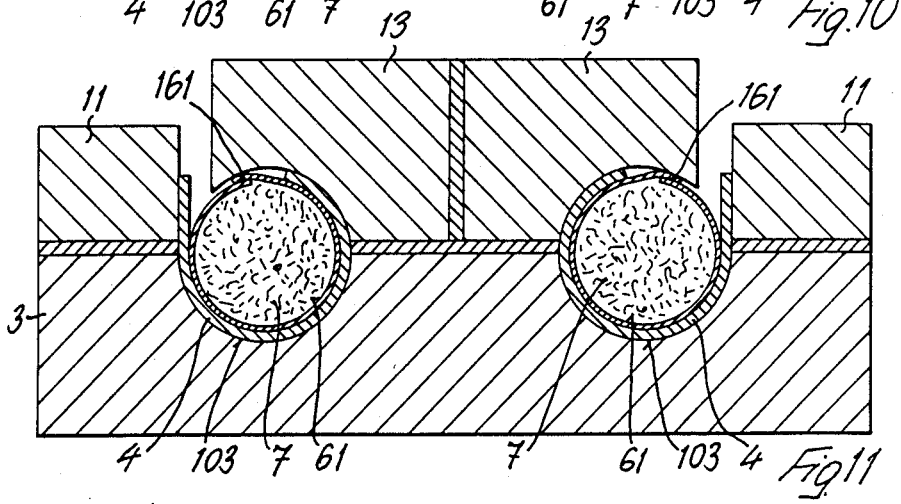
Fig.11

METHOD OF MAKING CIGARETTES BY SIMULTANEOUSLY FORMING TWO SIDE-BY-SIDE ARRANGED RODS, AND CIGARETTE-MAKING MACHINE FOR CARRYING OUT THE SAID METHOD

SUMMARY OF THE INVENTION

The invention relates to a method of making cigarettes by simultaneously forming two side-by-side arranged rods from only one shredded tobacco-feeding unit, and from only one twofold wide paper tape which is longitudinally split in the middle into two paper webs of a same width, from each one of which a cigarette rod is formed by the deposition of two respective tobacco strands and with the aid of two underlying, respective rod-forming folder belts which are led about a common driving pulley. The invention relates also to a cigarette-making machine for carrying out the said method.

According to the known methods, the twofold wide paper tape is at first longitudinally divided into two paper webs which are then fed in a coplanar side-by-side relation, and on each one of these two separate paper webs a tobacco strand is deposited, whereupon with the aid of the underlying rod-forming folder belt each web is wrapped and sealed around the respective tobacco strand or filler, whereby a cigarette rod (continuous cigarette) is formed. Because the two side-by-side arranged rod-forming folder belts are driven by only one driving pulley, a speed difference between the two paper webs may occur, since the dynamic behaviour of the two side-by-side arranged rod-forming folder belts generally differs, owing to inevitable differences in these two belts, even though they appear to be identical. The said speed difference brings about a different stress in the two paper webs, and may be the cause of troubles during the forming of the two side-by-side rods, particularly the testing of at least one of the two paper webs.

To compensate for the said speed difference between the two rod-forming folder belts, and to keep the tension of the two paper webs equal and constant, methods were proposed that require the use of independent, separate driving pulleys for the two rod-forming folder belts, and of members for directly or indirectly metering their tension, as well as of differential devices for adjusting the speed of at least one of the two driving pulleys. These solutions therefore result in a considerably complicated construction and in a sensibly increased cost.

The object of the invention is to solve in the simplest and most economical manner the problem arising from the two rod-forming folder belts being driven by only one driving pulley, that is to say, it aims to avoid or at least reduce any operating trouble and the tearing of the two paper webs, without using two independent, separate driving pulleys for the two rod-forming folder belts, and without the respective adjusting members.

This problem is solved by the invention with a method of the type as described in the preamble, substantially characterized by the following steps carried out in the stated order, in the direction in which the two rods are formed:

(a) the twofold wide starting paper tape which is fed in a substantially horizontal plane, is gradually deformed transversely between superposed stationary guides so as to be caused to assume a double trough-like profile;

(b) the thus deformed starting paper tape is then passed onto the two underlying, slidable rod-forming folder belts which are located in correspondence of the two troughs in the paper tape and are matingly deformed;

(c) on the double trough-like deformed, starting paper tape supported by the two rod-forming folder belts, two tobacco strands are deposited, one in each trough of said tape;

(d) the twofold wide starting paper tape is longitudinally severed intermediately between the two troughs thereof, whereby two trough-like profiled, separate, parallel paper webs are formed, which contain each a tobacco strand;

(e) wrapping each paper web transversely around the respective tobacco strand or filler, and fastening together the longitudinal edges thereof by applying paste thereto.

Preferably, between the steps (c) and (d), that is, after the deposition of a tobacco strand in each one of the two troughs formed in the twofold wide starting paper tape, and before having the said tape splitted by a median longitudinal cut into two paper webs provided each with a tobacco strand, a partial wrapping is effected of the two side edges of the starting paper tape around the respective tobacco strands deposited in the two troughs of said tape. Subsequently, during the step (e), that is, after the starting paper tape having been splitted into two separate paper webs, the just initial wrapping is completed of these paper webs around the respective tobacco strands or fillers.

The paste which is needed for pasting together the two longitudinal edges of each paper web wrapped around the respective tobacco strand or filler, may be applied to the twofold wide starting paper tape either before having the two tobacco strands deposited thereon, or after the deposition of the two tobacco strands, however before the longitudinal cutting of said tape for splitting it into two paper webs, or else the paste may be applied to the two paper webs after their separation by the median longitudinal cutting of the starting paper tape.

Anyway, by the method according to the invention, the twofold wide paper tape is longitudinally severed and splitted into two separate paper webs, and these two paper webs are individually and separately engaged by the respective rod-forming folder belts only after the deposition of the two tobacco strands on the said still whole paper tape, and after the trough-like deformation of the two portions of said tape which are meant for forming the said webs, and ever after a partial wrapping of two longitudinal side edges of the starting paper tape around the two tobacco strands. Therefore, it is accordingly shortened the time during which the two paper webs are separately subjected to the effect of the different dynamic behaviour of the associated rod-forming folder belts, and so to different, respective stresses. Moreover, the paper webs already trough-like deformed, or partially wrapped around the respective tobacco strands or fillers, have a greater strength. Thus, any trouble and any tearing of the two paper webs caused by the two rod-forming folder belts being passed around only one driving pulley, are avoided or at least substantially reduced.

For carrying out the method as above disclosed, the invention provides a cigarette-making machine equipped with two rod-forming lines arranged side-by-side, which are associated with only one shredded tobacco-feeding unit, and are fed with only one twofold wide starting paper tape, which rod-forming lines comprise each in known manner and in the rod-forming direction, a profiled, stationary, lower paper tape-guiding member, and a consecutive, profiled, stationary, lower folder belt-guiding member, and a rod-forming folder belt which is caused to run on the folder belt-guiding member, and means for forming and depositing a tobacco strand in correspondence for each rod-forming line, and a successive truncated cone-shaped semitubular tongue for compression of the tobacco strand, which is arranged over the rod-forming folder belt, and has its concave side turned downward, the two rod-forming folder belts in the two rod-forming lines being led about one single driving pulley. According to the invention, in a cigarette-making machine of the above disclosed type, the stationary lower paper tape-guiding member extends transversely across the width of both of the rod-forming lines arranged side-by-side, and the profile thereof which is substantially flat and horizontal at its inlet end, is gradually and smoothly transformed into a profile presenting two side-by-side troughs which are each associated with one rod-forming line, while the means for longitudinally cutting in the middle the two-fold wide paper tape fed onto the lower stationary paper tape-guiding member, between this member and two overlying paper tape-guiding tile members, are provided downstream of the tongues in the two rod-forming lines.

BRIEF DESCRIPTION OF THE DRAWINGS

These and other features of the invention, and the advantages arising therefrom will appear in more detail from the following specification of one preferred embodiment which is shown by way of a non-limiting example in the accompanying drawings, in which:

FIGS. 2 to 11 are diagrammatic cross-sectional views in an enlarged scale, taken on lines II—II to XI—XI in FIG. 1.

DESCRIPTION OF THE PREFERRED EMBODIMENTS

The cigarette-making machine according to the invention is so made as to have two side-by-side continuous cigarettes—the so-called cigarette rods—simultaneously formed and for this purpose it is provided with two side-by-side arranged rod-forming lines. At the inlet of this pair of rod-forming lines there is arranged a profiled paper tape-guiding lower member 1, which is stationary and extends transversely across the width of both of the rod-forming lines.

Figure 2:
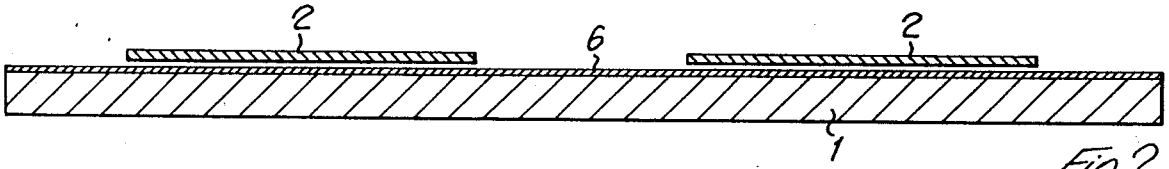
Figure 3:
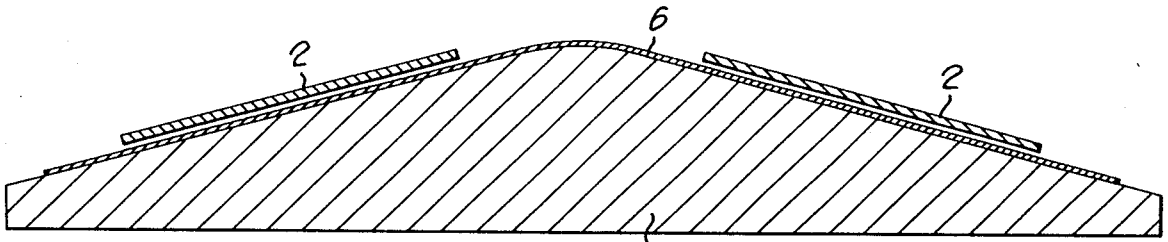
Figure 4:
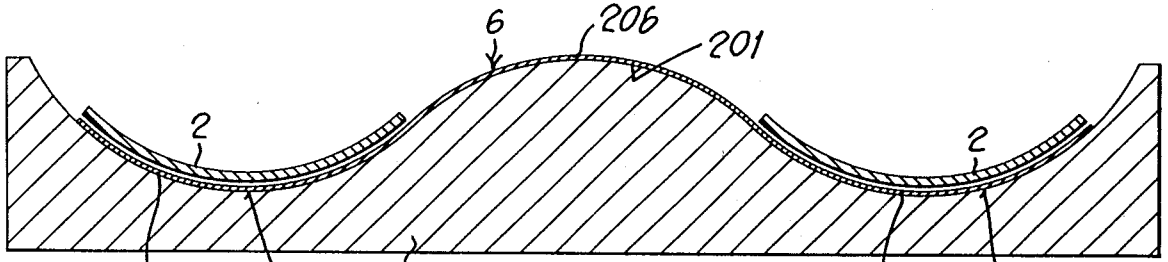
Figure 5:
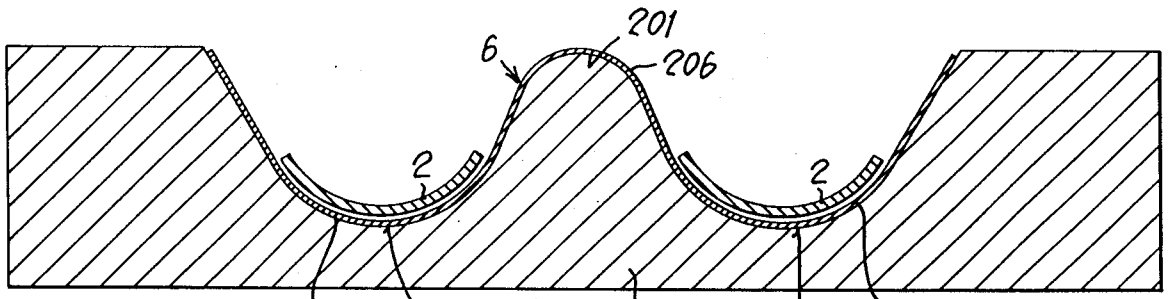
Figure 6:
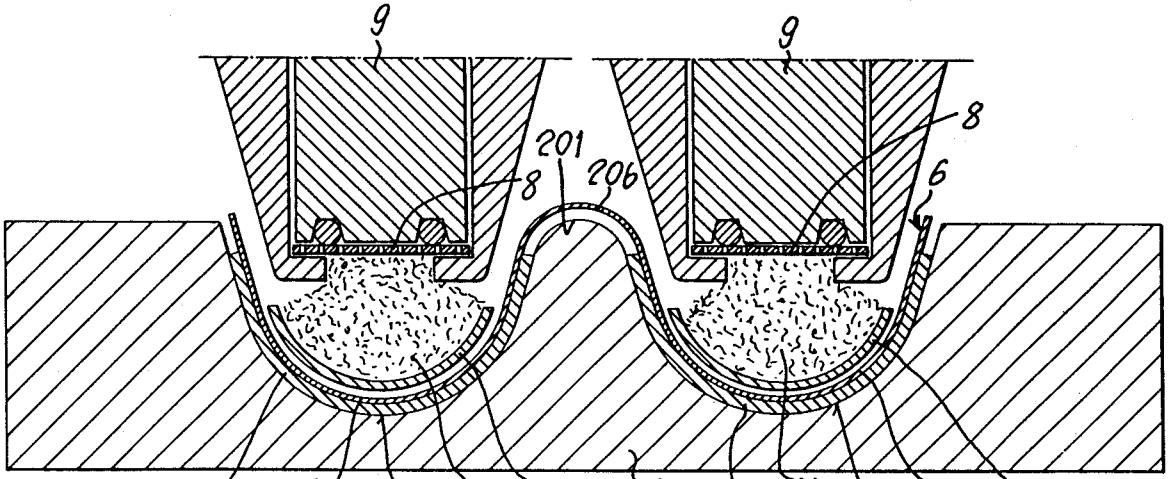

Over the said lower paper tape-guiding member 1, two stationary paper tape-guiding upper tile members 2 arranged in a side-by-side relation, extend in the longitudinal direction of the rod-forming lines, and are each associated with one of the two rod-forming lines. The lower paper tape-guiding member 1 is initially flat and substantially horizontal, and also the two upper paper tape-guiding tile members 2 are flat, and are substantially horizontal and co-planar, as it appears in FIG. 2. The upper surface of the paper tape-guiding member 1 then takes—in the direction F in which the pair of rods is formed, gradually and smoothly a cat's back profile, while the two upper paper tape-guiding tile members 2 are disposed in an inclined position on either sides of the cat's back profile, as shown in FIG. 3. The upper surface of the lower paper tape-guiding member 1 then takes—still gradually in the direction F and in a smooth manner—an undulated profile, with two lateral troughs 101 being each provided in correspondence of one of the two rod-forming lines, and with an intermediate convex portion 201, while the two upper paper tape-guiding tile members 2 are each received in one of the said troughs 101 and take a mating curvature, with their concave side turned upward, as shown in FIG. 4. While proceeding in the direction F in which the pair of rods is formed, the bending radii of the two lateral troughs 101, the intermediate convex portion 201, and the paper tape-guiding tile members 2 gradually decrease, while the distance between the longitudinal median axes of the two troughs 101 and the relative tile members 2 is gradually reduced, as shown in FIGS. 5 and 6. At the termination extremity of the lower paper tape-guiding member 1, the upper surface thereof and the two upper paper tape-guiding tile members 2 have the profile shown in FIG. 6.

Figure 7:
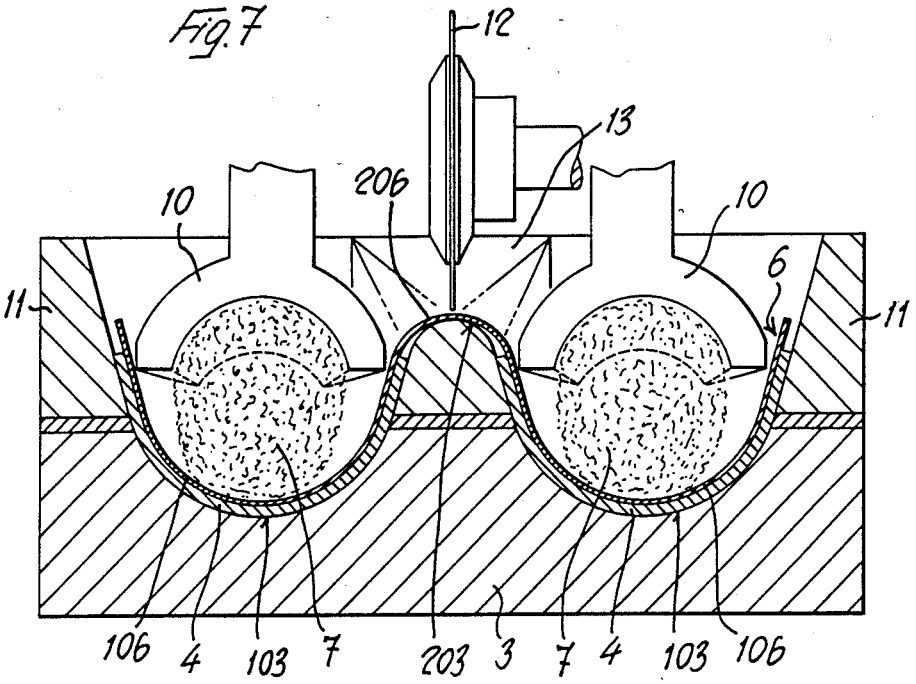

To the stationary paper tape-guiding lower member 1 there follows—in the direction F in which the pair of rods is formed—a stationary folder belt-guiding lower member 3 extending transversely across the entire width of the two rod-forming lines arranged side-by-side, and in correspondence of each one of them it presents a longitudinal trough 103 and an intermediate convex portion 203, as shown in FIG. 7.

The initial profile of the lower folder belt-guiding member 3 exactly corresponds to the final profile of the preceding lower paper tape-guiding member 1, and the two troughs 103 and the intermediate convex portion 203 at the starting extremity of the folder belt-guiding member 3 are perfectly in line with the two troughs 101 and the intermediate convex portion 201 at the termination extremity of the preceding paper tape-guiding member 1. While the two troughs 101 in the paper tape-guiding member 1 slightly converge toward each other in the direction in which the pair of rods is formed, the troughs 103 in the successive folder belt-guiding member 3 extend in parallel relation throughout the length of the respective lower folder belt-guiding member 3, each in correspondence of one rod-forming line.

On the lower folder belt-guiding member 3 there run two side-by-side arranged, rod-forming folder belts 4 which are led about a common driving pulley 5 and are caused to pass between the two paper tape-guiding and folder belt-guiding members 1, 3. Each one of these rod-forming folder belts 4 is associated with one rod-forming line and is received in the respective trough 103 of the lower folder belt-guiding member 3, as shown in FIGS. 7 to 11.

The two side-by-side rod-forming lines are fed with a paper tape 6 initially having a width which is the double of that of a paper web as required for the forming of a rod. This starting paper tape is fed in the direction of arrow F, between the stationary paper tape-guiding upper tile members 2 and the stationary paper tape-guiding lower member 1, so that at the termination extremity of the said lower paper tape-guiding member 1, the said tape assumes the transversal profile thereof, i.e., a double trough-like profile, with two longitudinal lateral troughs 106 and a convex median portion 206, as it appears from FIGS. 2 to 6. The thus double trough-like deformed starting paper tape 6 is then passed onto the two rod-forming folder belts 4 which have been also deformed like a trough with a mating profile, and by which the said tape is supported and accompanied during its further movement in the direction of arrow F, as it clearly appears in FIG. 7.

Figure 1:
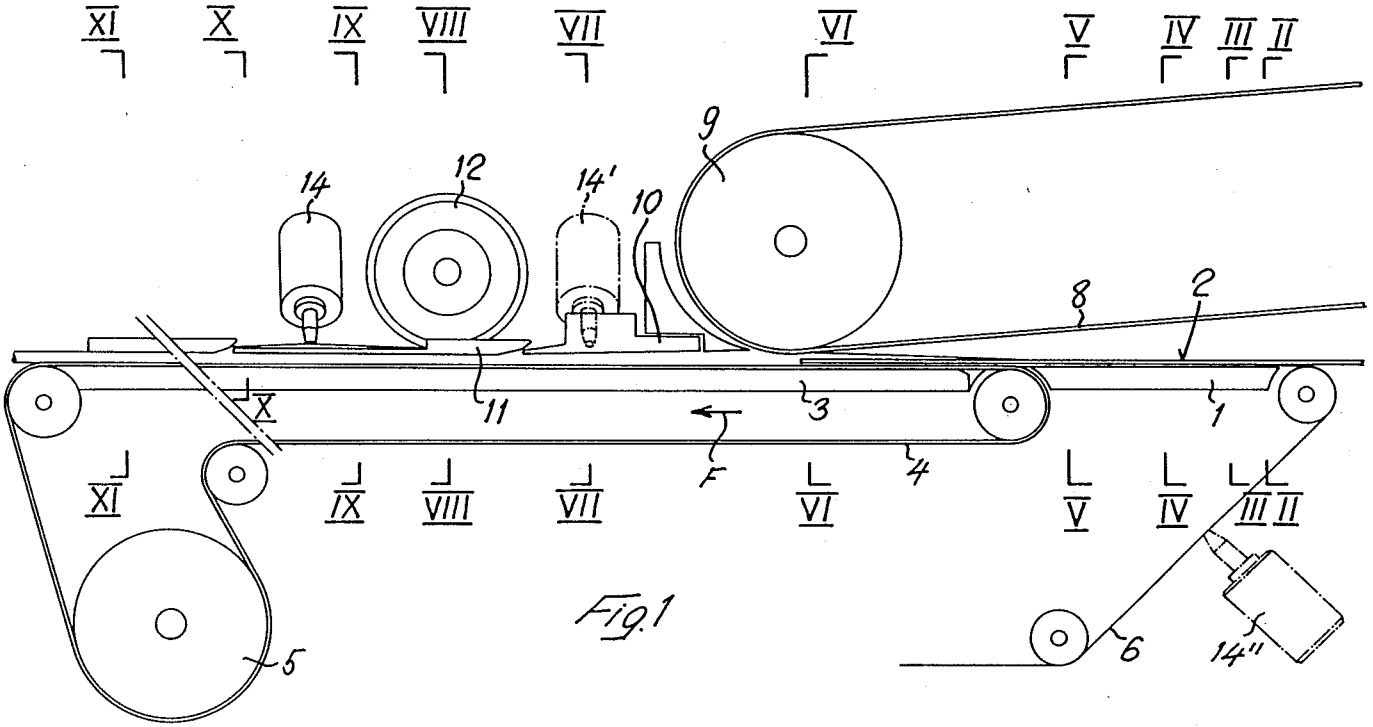
FIG. 1 is a view in side elevation, diagrammatically showing a cigarette-making machine for carrying out the method according to the invention.

The two upper paper tape-guiding tile members 2 extend for a certain length beyond the termination extremity of the lower paper tape-guiding member 1, each over one of the two rod-forming folder belts 4, as it appears in FIGS. 1 and 6.

At the termination extremity of the said paper tape-guiding tile members 2, in each one of the two troughs 106 of the starting paper tape 6 a tobacco strand 7 is deposited, which is formed and fed in known manner by a tobacco strand-forming respective suction belt 8. The two tobacco strand-forming belts 8 extend in a side-by-side relation over the upper paper tape-guiding tile members 2, and are led about respective guide wheels 9, as shown in FIGS. 1 and 6, and they take the shredded tobacco from one single common feeding unit, with which the cigarette-making machine is equipped.

The starting, double trough-like profiled paper tape 6 provided with two tobacco strands 7, one in each one of its troughs 106, is then caused to pass under two tongues 10 for compression of the tobacco strands 7, as shown in FIG. 7. These tongues 10 which are known per se, and are arranged in correspondence of the two rod-forming lines, consist each of a truncated cone-shaped semitubular member having its concave side turned downward, and flaring in the direction F in which the pair of rods is formed.

Figure 8:
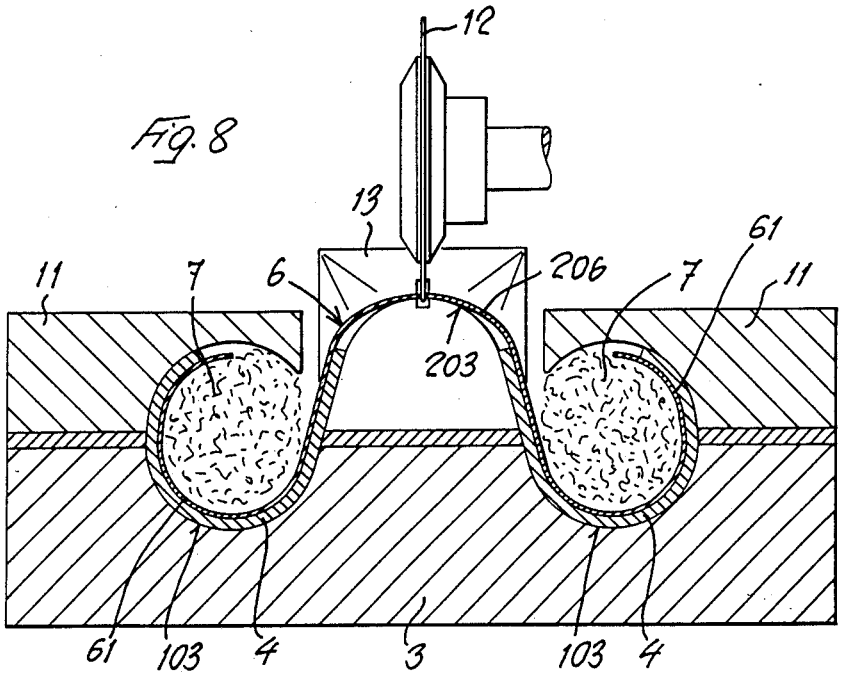

Downstream of the tongues 10 there begins the wrapping of the two longitudinal edges of the twofold wide starting paper tape 6 around the respective tobacco strands 7, as shown in FIG. 8. Such a wrapping is conventionally promoted by profiled bending members 11 provided in a stationary position over the lower folder belt-guiding member 3, at both sides thereof.

After a partial wrapping of the two longitudinal edges of the starting paper tape 6 around the respective tobacco strands 7, the said tape 6 is longitudinally severed in the middle, in correspondence of its convex median portion 206, for example by means of a circular rotary blade 12, as shown in FIG. 8, and may be with the cooperation of a stationary or rotary counter-blade. Thus, the twofold wide starting paper tape 6 is splitted into two paper webs 61 which are associated with two rod-forming lines and the respective rod-forming folder belts 4, and which are already partially wrapped around the respective tobacco strands 7. The complete wrapping and the longitudinal sealing of these two paper webs 61 around the respective tobacco strands or fillers 7 are conventionally effected with the aid of the external lateral bending members 11 and of associated internal lateral bending members 13 provided between the two rod-forming lines, as shown in FIGS. 9, 10 and 11. After the median longitudinal cutting of the twofold wide starting paper tape 6, the internal longitudinal edge 161 of each paper web 61 is at first so guided as to be caused to assume a substantially vertical position, and to each one of these two edges 161 adhesive is applied by two respective nozzle pasters 14 arranged downstream of blade 12, as shown with solid lines in FIG. 1 and in FIG. 9.

Figure 12:
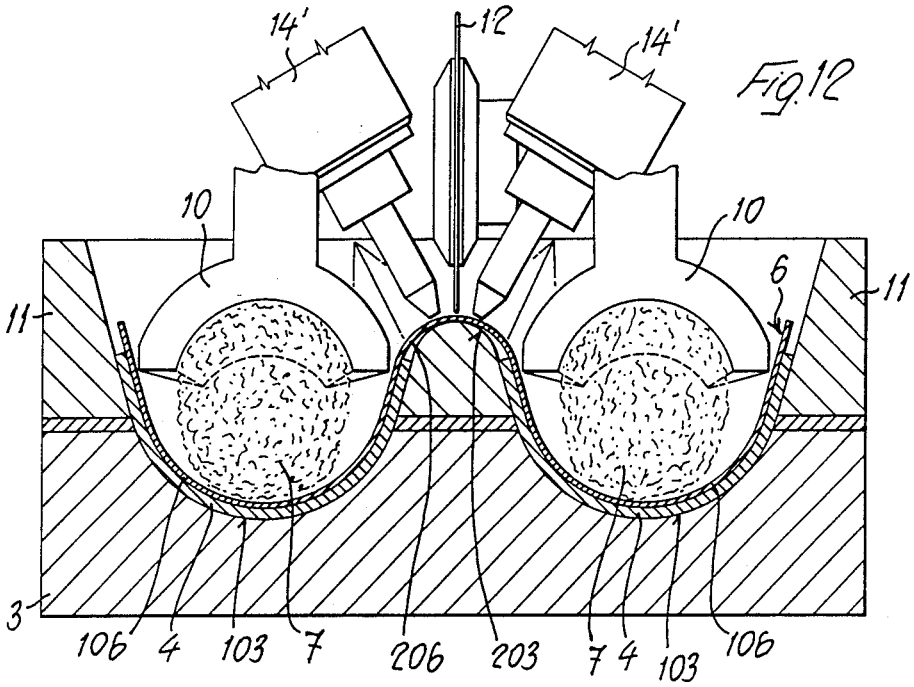
FIGS. 12 and 13 are views showing a modified embodiment in cross section on lines VII—VII and IX—IX in FIG. 1.
Figure 13:
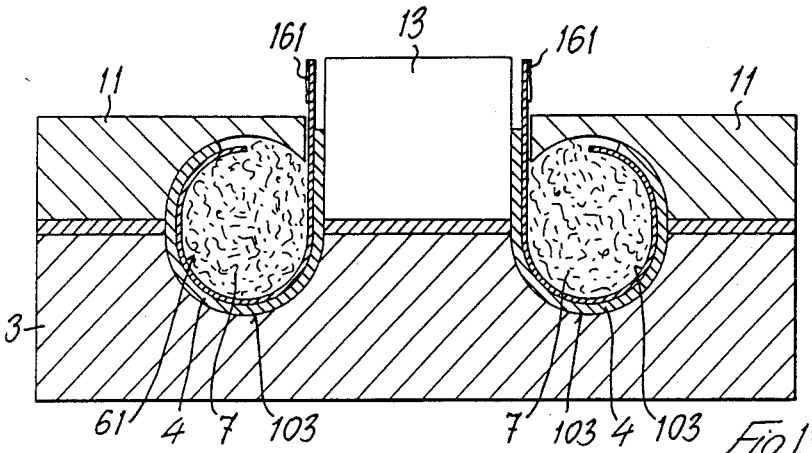

In a modified embodiment of the invention, shown in FIGS. 12 and 13, the adhesive for longitudinally sealing the two paper webs 61 wrapped around the two tobacco strands or fillers 7, is applied to the twofold wide starting paper tape 6 before having it longitudinally cut in the middle. For this purpose, upstream of the blade 12, for example in correspondence of the tongues 10, two nozzle pasters 14' are provided, which apply two spaced apart parallel lines of adhesive to either sides of the median longitudinal cutting line along which the starting paper tape 6 will be severed, as shown by dash-and-dot lines in FIG. 1, and particularly in FIG. 12. After the median longitudinal cutting of the paper tape 6 by the blade 12, the internal edges 161 of the two paper webs 61 result to be already provided with adhesive, as shown in FIG. 13.

The two lines of adhesive may be laid on the twofold wide starting paper tape 6 even in any other point before the longitudinal median cutting of said tape 6, more particularly, even before the deposition of the two tobacco strands 7 on said tape 6 and, for example, even before the feeding of tape 6 to the two side-by-side arranged rod-forming lines, for example by means of two nozzle pasters 14'', shown by dash-and-dot lines in FIG. 1.

From the foregoing, it is clearly apparent that the effect caused by the different dynamic behaviour of the two rod-forming folder belts 4 in the two rod-forming lines is eliminated or is at least sensibly reduced, thanks to the shortening of the section along which the said folder belts 4 cooperate with the two separate paper webs 61, and thanks to the fact that the longitudinal cutting of the twofold wide starting paper tape 6 is effected downstream of the tongues 10, where the frictional forces occur with a greater intensity, and the paper webs 61 are already partially wrapped around the respective tobacco strands 7.

I claim:

1. A method of making cigarettes, or the like, by simultaneously forming two side-by-side arranged rods from only one unit for feeding shredded tobacco, or the like, and from only one twofold wide paper tape (6) which is longitudinally split into two paper webs (61), from each one of which a cigarette rod is formed by the deposition of two respective tobacco strands and with the aid of two underlying, respective rod-forming folder belts (4) which are led about a common driving pulley (5), characterized by the following steps carried out in the stated order, in the direction (F) in which the pair of rods is formed:

(a) the twofold wide starting paper tape (6) which is fed in a substantially horizontal plane, is gradually deformed transversely between superposed stationary guides (1 and 2) so as to be caused to assume a double trough-like profile (106,206,106);

(b) the thus deformed starting paper tape (6) is then passed onto the two underlying, slidable rod-forming folder belts (4) which are located in correspondence of the two troughs (106) in the paper tape (6), and are matingly deformed;

(c) on the double trough-like deformed (106,206,106), starting paper tape (6) supported by the two rod-forming folder belts (4), two tobacco strands (7) are deposited, one in each trough (106) of the said tape (6);

(d) the twofold wide starting paper tape (6) is longitudinally severed intermediately between the two troughs (106) thereof, whereby two trough-like profiled, separate, parallel paper webs (61) are formed, which contain each a tobacco strand (7);

(e) wrapping each paper web (61) transversely around the respective tobacco strand or filler (7), and fastening together the longitudinal edges (161) thereof, by applying paste thereto.

2. The method according to claim 1, characterized in that after the deposition of the tobacco strands (7) in the two troughs (106) formed in the twofold wide starting paper tape (6) (step c), and before having the said tape (6) split by a longitudinal cut into two paper webs (61) provided each with a tobacco strand (7) (step d), a partial tape (6) around the respective tobacco strands (7).

3. The method according to claim 1, characterized in that the paste which is needed for pasting together the two longitudinal edges (161) of each paper web (61) wrapped around the respective tobacco strand or filler (7), may be applied to the twofold wide starting paper tape (6) at both sides of the future longitudinal cutting line, either before having the two tobacco strands (7) deposited on the said tape (6), or after the deposition of the two tobacco strands (7), however before the longitudinal cutting of said tape (6) for splitting it into two paper webs (61), or else the paste may be applied to the edges (161) of the two paper webs (61) after they have been separated by longitudinally cutting the twofold wide starting paper tape (6).

4. A cigarette-making machine provided with two rod-forming lines arranged side-by-side, which are associated with only one shredded tobacco-feeding unit, and are fed with only one twofold wide starting paper tape (6), which rod-forming lines comprise each in the rod-forming direction (F), a profiled, stationary, lower paper tape-guiding member (1), and a consecutive, profiled, stationary lower folder belt-guiding member (3), and a rod-forming folder belt (4) which is caused to run on the folder belt-guiding member (3), and means (8,9) for forming and depositing a tobacco strand (7) in correspondence of each rod-forming line, and a successive truncated cone-shaped semitubular tongue (10) for compression of the tobacco strand (7), which is arranged over the rod-forming folder belt (4) in the two rod-forming lines being led about one single driving pulley (5), characterized in that the lower paper tape-guiding member (1) extends transversely across the width of both of the rod-forming lines arranged side-by-side, and the profile thereof which is substantially flat and horizontal at its inlet end, is gradually and smoothly transformed to a profile wherein the rod forming lines are arranged side-by-side and each of said sides are inclined upwardly and are joined at an apex and which is then gradually transformed into a successive undulated profile presenting two side-by-side troughs (101) which are each associated with one rod-forming line, while downstream of the tongues (10) in the two rod-forming lines, means (12) are provided for longitudinally cutting in the middle the twofold wide starting paper tape (6) fed between the lower paper tape-guiding member (1) and two overlying paper tape-guiding tile members (2) having their concave side turned downward.

5. The cigarette-making machine according to claim 4, characterized in that a lower folder belt-guiding member (3) is associated with the two rod-forming lines arranged side-by-side, and extends transversely across the width of both of the rod-forming lines, and in correspondence of each one of them it presents a trough-like profile (103), the folder belt-guiding member (3) being slightly spaced apart in the axial direction from the preceding paper tape-guiding member (1), so as to permit the passage of the two side-by-side arranged rod-forming folder belts (4), while the double trough-like profile (101,201,101) of the termination extremity of the paper tape-guiding member (1) is the same as, and is in line with the double trough-like profile (103,203,103) of the starting extremity of the folder belt-guiding member (3).

6. The cigarette-making machine according to claim 4 characterized in that the two troughs (101) in the paper tape-guiding member (1) slightly converge toward each other in the direction (F) in which the pair of rods is formed, while the two troughs (103) in the folder belt-guiding member (3) are parallel to each other.

7. The cigarette-making machine according to claim 4, characterized in that the means for longitudinally cutting the twofold wide starting paper tape (6) consist of a circular rotary blade (12) arranged in correspondence of a median convex portion (203) of the folder belt-guiding member (3) between the two troughs (103) thereof, and may be of a stationary or rotary counter-blade.

8. The cigarette-making machine according to claim 4, characterized by pasting means (14) located downstream of the means (12) of longitudinally cutting the twofold wide starting paper tape (6), and which are adapted for applying adhesive to the edges (161) of the two paper webs (61) obtained by longitudinally cutting the said tape (6).

9. The cigarette-making machine according to claim 4, characterized by pasting means (14', 14") located upstream of the means (12) for longitudinally cutting the twofold wide starting paper tape (6), either before or after the means (8, 9) for effecting the deposition of the tobacco strands (7), and which are adapted for applying adhesive to either sides of the future longitudinal cutting line along which the starting paper tape (6) will be severed.

* * * * *